US012127652B2

(12) United States Patent
Solomon

(10) Patent No.: US 12,127,652 B2
(45) Date of Patent: Oct. 29, 2024

(54) MULTI-FUNCTIONAL STRAP FOR PROVIDING VARIOUS PERSONAL ITEM CARRYING CONFIGURATIONS

(71) Applicant: Newlight Technologies, Inc., Huntington Beach, CA (US)

(72) Inventor: Yotam Solomon, Marina Del Rey, CA (US)

(73) Assignee: Newlight Technologies, Inc., Huntington Beach, CA (US)

( * ) Notice: Subject to any disclaimer, the term of this patent is extended or adjusted under 35 U.S.C. 154(b) by 0 days.

(21) Appl. No.: 17/127,931

(22) Filed: Dec. 18, 2020

(65) Prior Publication Data

US 2021/0186170 A1 Jun. 24, 2021

Related U.S. Application Data

(60) Provisional application No. 62/951,369, filed on Dec. 20, 2019.

(51) Int. Cl.
*A45C 13/30* (2006.01)
*A45C 13/10* (2006.01)

(52) U.S. Cl.
CPC ..... *A45C 13/30* (2013.01); *A45C 13/10* (2013.01); *A45C 2013/303* (2013.01)

(58) Field of Classification Search
CPC ... A45C 13/30; A45C 13/10; A45C 2013/303; A45C 1/02
USPC ..... 150/107, 108, 110
See application file for complete search history.

(56) References Cited

U.S. PATENT DOCUMENTS 509,341 A * 11/1893 Ward ..... A45F 5/00 224/220
522,809 A * 7/1894 Tompkins ..... A45F 5/00 224/220
2,392,533 A * 1/1946 Isaac ..... A45C 1/04 224/221
2,394,782 A * 2/1946 Kalske ..... A45F 3/02 150/108

(Continued)

FOREIGN PATENT DOCUMENTS

KR 200474193 Y1 * 8/2014
KR 20140004613 U * 8/2014

OTHER PUBLICATIONS

The Leatherguy: How to set Chicago Screws: https://www.youtube.com/watch?v=L-_rdRnpuBI (Year: 2016).*

(Continued)

*Primary Examiner* — Don M Anderson
*Assistant Examiner* — Justin Caudill
(74) *Attorney, Agent, or Firm* — Snell & Wilmer L.L.P.

(57) ABSTRACT

The present invention relates to a multi-functional strap which provides the user with various carrying configurations for personal items. More specifically, the multi-functional strap of the present invention allows the user it reconfigure the handbag to function as a purse, wristlet, or clutch. According to one configuration, a wristlet with a multi-function strap system includes a bag portion having an inside and an outside, two or more loops formed on one end of said bag portion and a strap having two ends wherein said strap is threaded through one of the available loops and the ends are coupled together.

11 Claims, 5 Drawing Sheets

(56) References Cited

U.S. PATENT DOCUMENTS 2,710,639 A * 6/1955 Farls ..... A45F 3/00 383/76
3,613,759 A * 10/1971 Collings ..... A45C 3/06 150/120
4,515,300 A * 5/1985 Cohen ..... A45F 3/04 224/579
4,763,763 A * 8/1988 Sadow ..... A45F 3/02 150/108
4,810,102 A * 3/1989 Norton ..... A45F 5/02 150/108
5,135,455 A * 8/1992 King ..... A63B 21/0726 482/108
5,307,966 A * 5/1994 Inaba ..... A45F 3/02 224/267
5,431,317 A * 7/1995 Kliot ..... A45F 3/04 224/259
5,577,652 A * 11/1996 Cooper ..... A45F 3/04 224/608
6,220,493 B1 * 4/2001 Iijima ..... A45F 3/02 224/153
6,595,703 B1 * 7/2003 Laituri ..... A45C 13/30 396/423
6,612,350 B1 * 9/2003 Brynjulfsen ..... A45C 13/10 224/231
8,746,523 B1 * 6/2014 Woolley ..... A45C 13/30 224/578
9,861,078 B1 * 1/2018 Mantelli ..... A01K 27/008
2008/0277434 A1 * 11/2008 Sacks ..... A45C 13/30 224/579
2011/0226827 A1 * 9/2011 Bourgeois ..... A45C 13/30 224/257
2013/0276942 A1 * 10/2013 Waggoner ..... A45C 13/30 150/108
2015/0164191 A1 * 6/2015 Hause ..... A45C 3/06 150/118
2019/0124891 A1 * 5/2019 Swinton ..... A45C 11/24
2019/0133277 A1 * 5/2019 Hackett ..... A45C 13/30
2019/0191857 A1 * 6/2019 Nesbit ..... A45F 4/02
2019/0261750 A1 * 8/2019 Morales ..... A45C 13/24
2020/0015561 A1 * 1/2020 Warner ..... A45F 3/14

OTHER PUBLICATIONS

Leather Guy: How to set the Chicago Screw https://www.youtube.com/watch?v=L-_rdRnpuBI (Year: 2016).*

* cited by examiner

MULTI-FUNCTIONAL STRAP FOR PROVIDING VARIOUS PERSONAL ITEM CARRYING CONFIGURATIONS

CROSS REFERENCE TO OTHER APPLICATIONS

This application claims benefit of priority to U.S. Provisional Application No. 62/951,369, filed Dec. 20, 2019, the disclosure of which is fully incorporated herein by reference.

BACKGROUND OF THE INVENTION

1. Field of the Invention

The present specification generally relates to personal items that may be carried. More specifically, the present invention relates to personal items having a multi-functional strap which provides the user with various configurations for holding, such as a handle, wristlet, or clutch.

2. Description of the State of the Art

The handbag dates back more than 5000 years; however, it was not until the industrial revolution, due in part to increased travel, that the modern handbag or pursue was born out of necessity in England. Today, whether an expression of style and/or mood, the handbag comes in a plethora of designs and is a convenient place to store and transport personal items such as keys, money, credit cards, ID, smart devices, personal items and a few makeup products.

Depending upon the functionality and/or fashion considerations, handbags can be categorized according to the silhouette of the bag, as well as the type of handle. In some instances the handle is simply a strap secured to opposing ends of the bag to form the handbag, or the handle is foregone altogether forming a clutch. Handbags may also be designed with a strap that loops around the user's wrist. Since the strap in this configuration resembles a bracelet worn on the wrist, the handbags are known as wristlets. These bags are especially handy for a night out when only a few essentials are needed.

Thus, a need exists for a single handbag capable of being easily configured so as to have varying functionalities and/or fashion considerations, while eliminating the need to purchase multiple handbags and constantly move personal items from one handbag to the other handbag depending on the personal circumstance.

BRIEF SUMMARY OF THE INVENTION

It is an object of the present invention to provide a multi-functional strap attachment to any personal item or accessory thereby allowing the user the ability to easily convert such personal item to or from a wristlet configuration without physically modifying the body of the wristlet's original construction. The wristlet can be configured to held by the handle like a purse or in the hand like a clutch depending upon the individual circumstance.

It is an object of the present invention to provide for the ability to convert a wristlet to either a handbag or a clutch, thus allowing the wristlet to easily become a multi-purpose accessory without physically modifying the body of the wristlet's original construction.

It is another object of the present invention to provide a cell phone case with a multi-functional strap attachment allowing the user to carry the cell phone in a either a wristlet, handle or clutch configuration.

It is another object of the present invention to provide shoes with a multi-functional strap attachment allowing the user to carry the phone in a either a wristlet, handle or clutch configuration.

Other objects and advantages will be apparent upon reading the description hereinafter.

Additional embodiments and features are set forth in the description that follows, and in part will become apparent to those skilled in the art upon examination of the specification or may be learned by the practice of the disclosed embodiments. The features and advantages of the disclosed embodiments may be realized and attained by means of the instrumentalities, combinations, and methods described in the specification.

BRIEF DESCRIPTION OF THE DRAWINGS

A further understanding of the nature and advantages of the disclosed embodiments may be realized by reference to the remaining portions of the specification and the drawings. All drawings are not to scale.

Figure 1A:
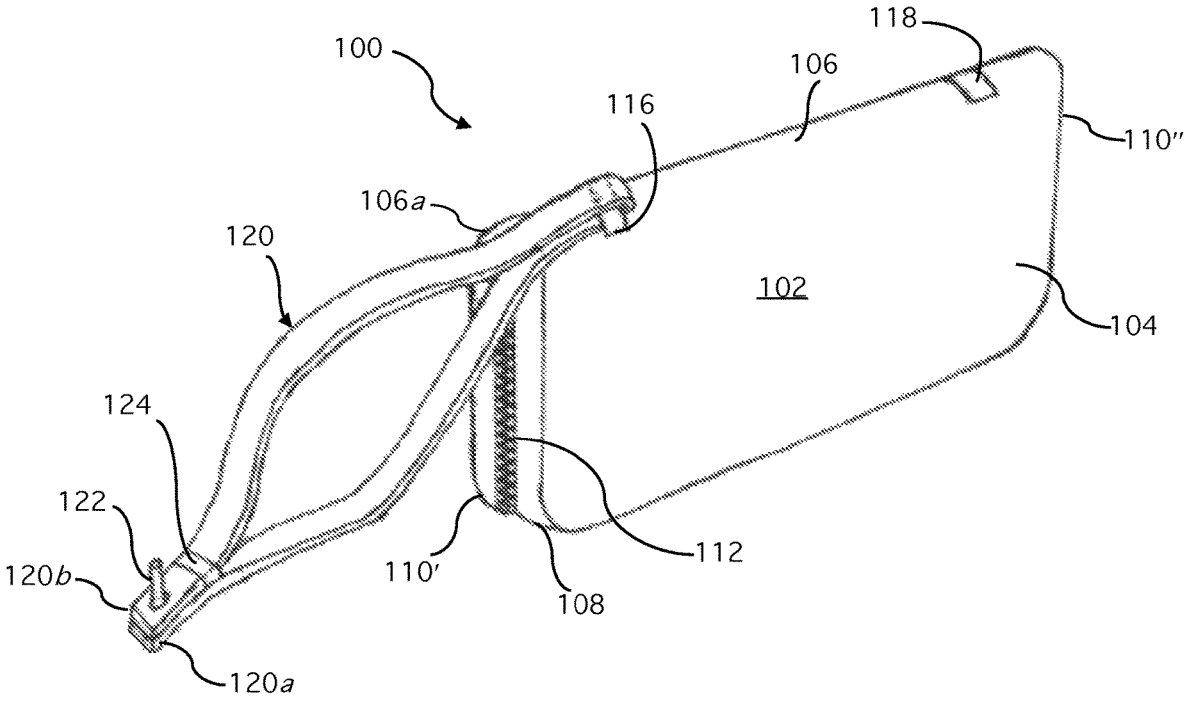
FIG. 1A is a perspective view of an embodiment of a wristlet with a multi-function strap according to a first configuration.

While the invention is amenable to various modifications, specifics thereof have been shown by way of in the drawings and will be described in detail in the following more detailed description. It should be understood, however, that the intention is not to limit the invention to the particular embodiments described. On the contrary, the intention is to cover all modifications, equivalents, and alternatives falling within the spirit and scope of the invention as defined by the appended claims.

In the appended figures, similar components and/or features may have the same reference label. Further, various components of the same type may be distinguished by following the reference label by a dash and a second label that distinguishes among the similar components. If only the first reference label is listed in the specification, the description is applicable to anyone of the similar components having the same first reference label irrespective of the second reference label.

DETAILED DESCRIPTION OF THE INVENTION

The present invention is best shown in Figure FIGS. 1A through 1D showing a wristlet (as the starting configuration) with a multi-function strap system 100 comprising a strap 120, a personal item 102 such as but not limited to a bag, cell phone case, shoes, slippers, flipflops, keychains, folios, wallet, etc. and wherein said personal item 102 has two or more loops positioned in parallel for securing said strap 120 in either a wristlet configuration or a stored position. As discussed in further detail below, strap 120, 220, 320 and 420 is attached according to a first configuration in FIGS. 1A-1D, a second configuration in FIGS. 2A-2C, a third configuration in FIGS. 3A-3B, and fourth configuration 420, respectively. The various configurations described below are meant to be exemplary of the versatility of the multi-strap system of the present invention and the personal items are purely illustrative and those of skilled in the art will recognize the various modifications, alternative constructions, and equivalents that may be used without departing from the spirit of the disclosed embodiments.

The bag portion 102 in its most basic configuration has an inside (not shown), an outside 104, a spine or bottom end 106, a top end 108, opposite ends 110' and 110", and a closure assembly 112 such as, but not limited to a zipper, clasp, teardrop closure, kiss lock closure, squeeze frame, magnetic, hook and loop fastener etc. As shown in FIGS. 1A-1D the wristlet is a zip-around style having a closure assembly 112 positioned along end 110', top end 108, and end 110". However, it will be recognized by those of skill in the art that various constructions of bag portion 102 may be used without departing from the spirit of this disclosure. For instance, opposite ends 110' and 110" could be closed and the closure assembly 112 would then only allow access to the inside of the bag portion 102 through top end 108. The bag portion 102 may further be constructed of AirCarbon®, leather, vegan leather, vinyl, synthetic fabrics, non-synthetic fabrics, 3D printed fabrics and/or any other appropriate material. Construction from durable, lightweight materials may be preferred but is not required.

Spine 106 having opposed ends 106*a* and 106*b* has two strap loops 116 and 118 positioned near the ends 106*a* and 106*b*, respectively of the spine 106 and perpendicular to the longitudinal axis of spine 106. Strap loops 116 and 118 are each formed by securing the opposing ends of a strip of material, which may be, but does not necessarily have to be, made from the same material as that of bag portion 102, to spine 106 using stitching or the like. Alternatively, loop 116 can be formed near spine end 106*a* by placing parallel slits in spine 106 perpendicular to the axis of spine 106 and this procedure is repeated near spine end 106*b* to form loop 118. The width of the resulting loops 116 and 118 is determined by the distance between the two parallel slits and the length of the slits would have a length greater than the width of the strap 120 thereby allowing strap 120 to be threaded through the resulting loops.

In the wristlet configuration, as shown in FIG. 1A, the strap 120 having opposed first and second ends 120*a* and 120*b*, respectively is threaded through the loop 116 and opposed ends 120*a* and 120*b* are mated and secured together through the use of a fastener 122. Strap 120 may further comprise a keeper loop 124 positioned near one of the strap ends allowing the other strap end to pass through to assist in keeping the strap 120 in place. If desired strap 120 can also comprise a free loop (not shown), which is an extra loop positioned next to the keeper loop 124. The free loop can be moved around the strap of the wristlet to adjust the size of the wristlet and further aids in fastening the strand 120 to the wrist. A wide variety of fasteners may be utilized for fastener 122, such as but not limited to screw posts, such as a Chicago screw, snaps having female snap element and male snap element, magnets, button studs, etc. The primary requirement when choosing the type of hardware for fastener 122 is that one or both ends 120*a* and 120*b* are free to thread through the various loops holding strap 120 in place. FIG. 1A displays a screw post as fastener 122 attached to end 120*a* and opposed end 120*b* has a hole 126 for receiving fastener 122. As discussed previously, there are a variety of fasteners that can be used and it is to be understood the depending upon the particular hardware used various modifications to ends 120*a* and 120*b* may be necessary. For example, if fastener 120 is a snap, the female or male snap element would be secured to end 120*a*, and 120*b* instead of having a hole for receiving a screw post, would have the corresponding male or female snap element counterpart to that secured to end 120*a*. The strap 120 may further be constructed of AirCarbon®, leather, vinyl, synthetic fabrics, non-synthetic fabrics, and/or any other appropriate material. Construction from durable, lightweight materials may be preferred but is not required.

Figure 1B:
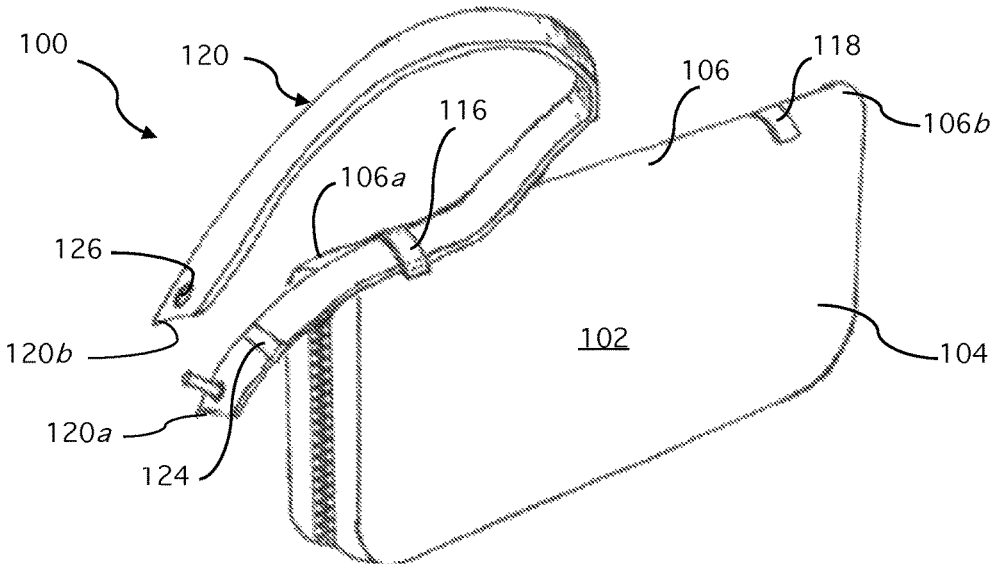
FIG. 1B is a perspective view of the embodiment of a wristlet shown in FIG. 1A with the ends of the multi-function strap unfastened according to a first configuration.

In using the handbag with the multi-function strap system 100, a user may easily alter the attachment of strap 120 to the bag portion 102 as set forth below to obtain a configuration that is most desirable at any given time. The wristlet configuration as shown in FIG. 1A may be altered to the handbag configuration shown in FIG. 1D by first disengaging ends 120*a* and 120*b* from one another and sliding end 120*b* out from keeper loop 124 as shown in FIG. 1B. Next, the user threads end 120*b* through loop 118 and then ends 120*a* and 120*b* are once again couple to one another, shown in FIG. 1C so that strap 120 is essentially folded over on itself forming a handle that can be grasped by the users fingers as shown in FIG. 1D.

Figure 2A:
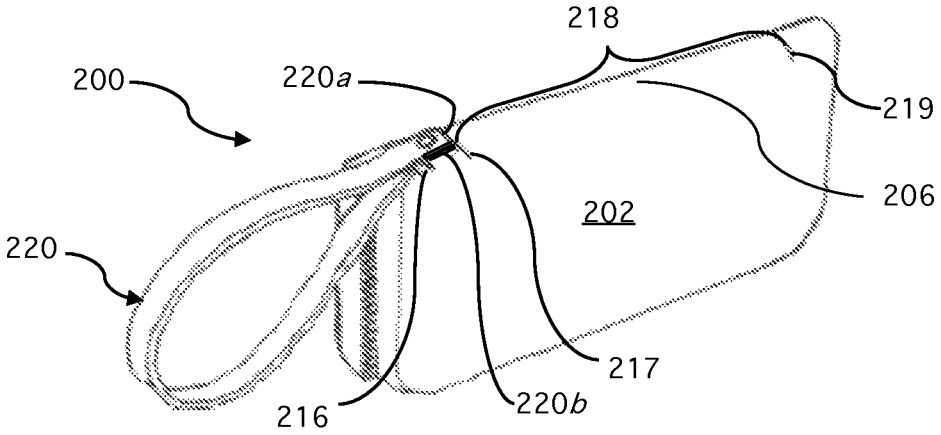
FIG. 2A is a perspective view of an embodiment of a wristlet with a multi-function strap according to a second configuration.
Figure 2B:
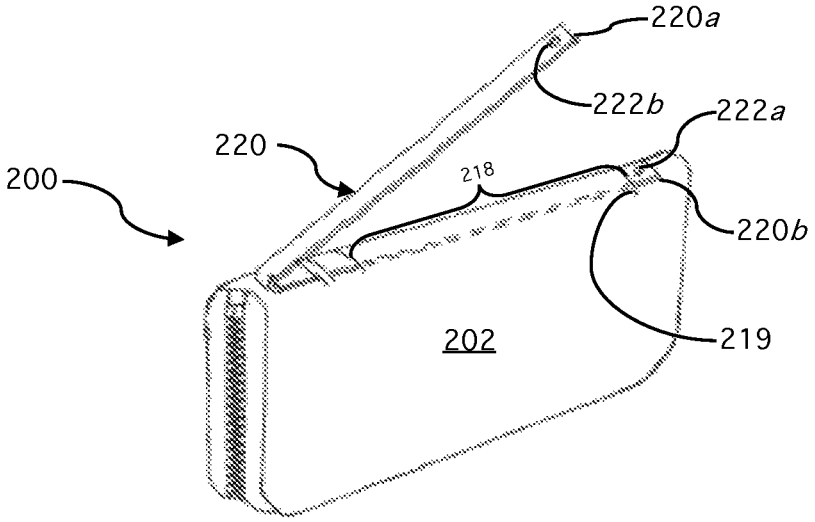
FIG. 2B is a perspective view of an embodiment of a wristlet shown in FIG. 2A with an unfastened multi-function strap according to a second configuration.
Figure 2C:
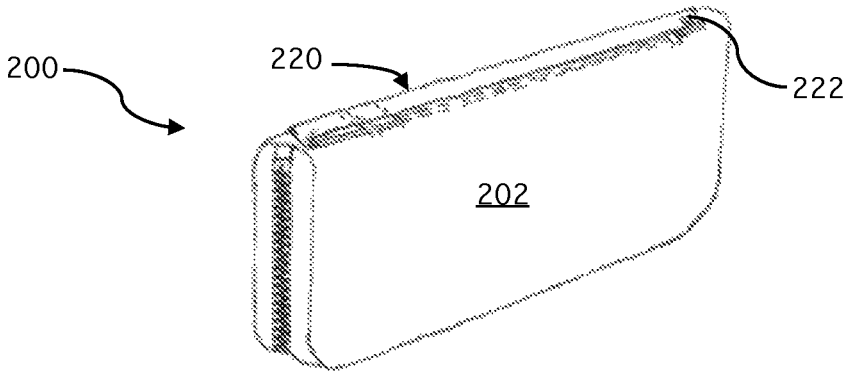
FIG. 2C is a perspective view of an embodiment of a wristlet with a fastened multi-function strap to form a handbag according to a second configuration.

In a second configuration 200 shown in FIGS. 2A-2C bag portion 202 has a spine 206 having one loop 216 that connects strap 220 to bag portion 202 and a second loop 218 that is formed by placing a first cut 217, proximal to loop 216, in the spine 206 of bag potion 202 perpendicular to the axis of spine 206 and a second cut 219 that is parallel to the first cut 218 in close proximity to spine end 206*b* to form loop 218. Loop 218 could also be formed by stitching a wide piece of material over the surface of spine 206.

Figure 1C:
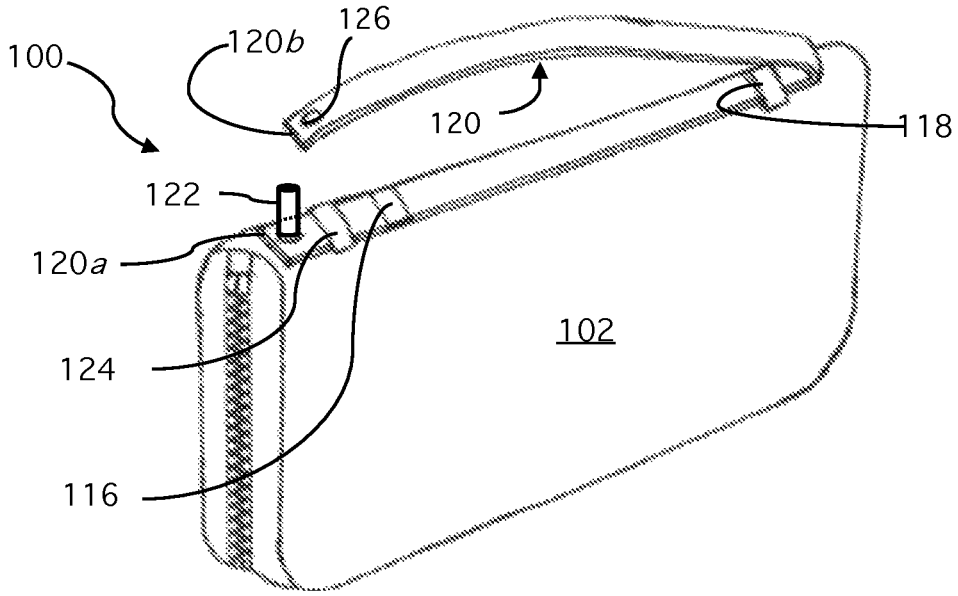
FIG. 1C is a perspective view of the embodiment of a wristlet shown in FIG. 1A-1B with the one free end of the multi-function strap having been threaded through a second loop according to a first configuration.
Figure 1D:
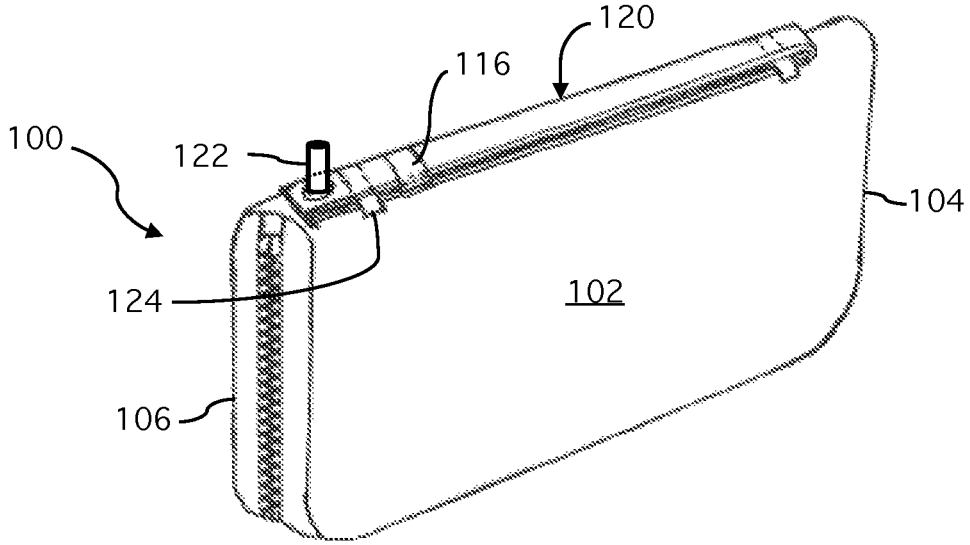
FIG. 1D is a perspective view of the embodiment of a wristlet shown in FIG. 1A-1C with the one free end of the multi-function strap having been secured to its opposing end to form a handbag according to a first configuration.

The ends 220*a* and 220*b* of strap 220 are separated from one another and end 220*b* is further threaded through loop 118 until end 220*b* is visible past cut 219 (FIG. 1B) and then ends 220*a* and 220*b* are once again coupled to one another by mating female snap element 222*a* and male snap element 222*b* or the like forming fastener 222 (FIG. 1C). By threading strap 220 through the majority of spine 206 a more streamlined configuration of the handbag is formed, wherein the user is able to hold onto strap 220 but only about half of the strap is visible.

Figure 3A:
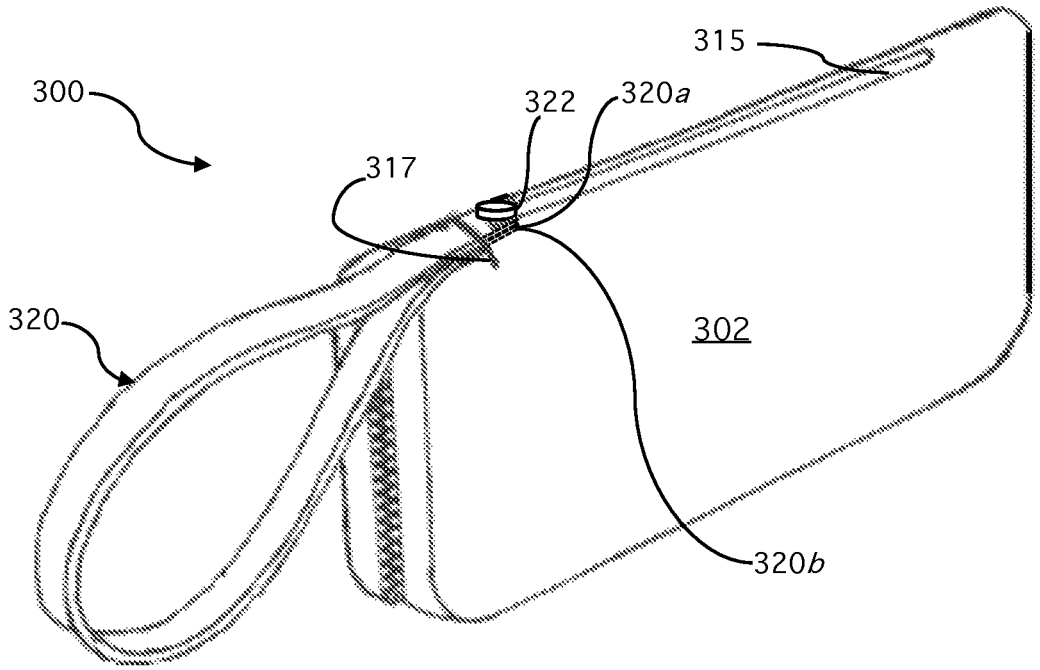
FIG. 3A is a perspective view of an embodiment of a wristlet with a multi-function strap according to a third configuration.
Figure 3B:
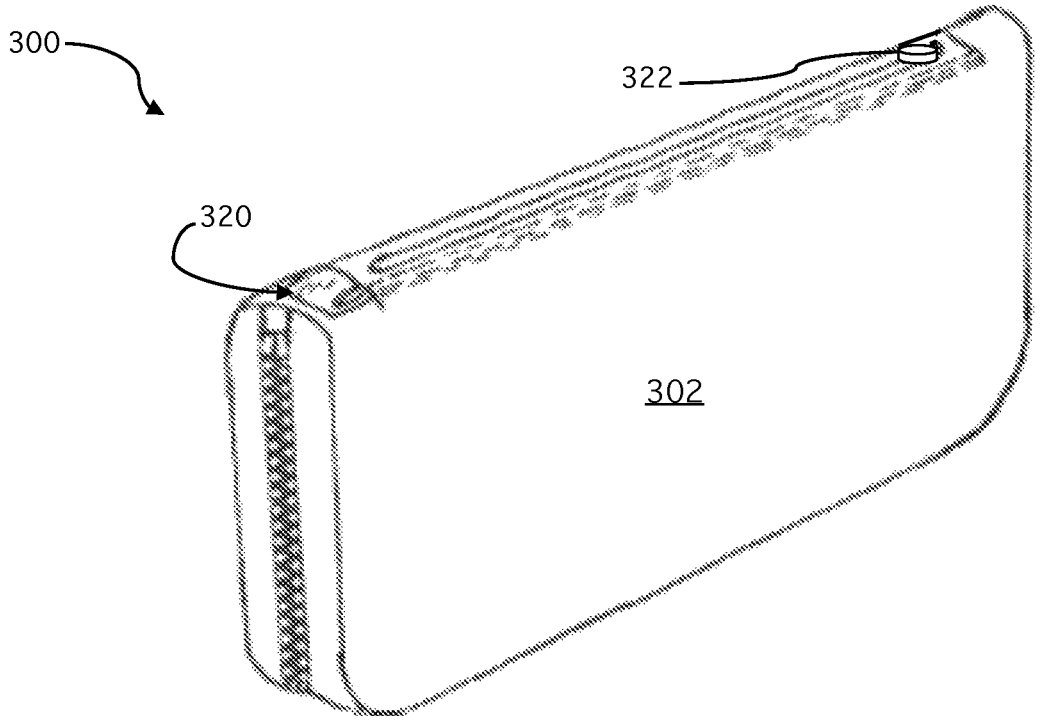
FIG. 3B is a perspective view of an embodiment of a wristlet with a multi-function strap hidden from view to form a clutch according to a third configuration.

In the third configuration, shown in FIGS. 3A-3B, the spine 306 of bag portion 302 has a slot 315 positioned along a portion of the axis of spine 306. The strap 320 has two opposed ends 320*a* and 320*b* coupled to one another are inserted into slit 317 so that the fastener 322 protrudes through slot 315. Fastener 322 can be a Chicago screw style having a shaft wherein the shaft has a diameter less than the width of slot 315 and a head that screws onto the shaft wherein the head has a diameter greater the width of slot 315. When fastener 322 is positioned proximal to slit 317 the strap 320 will form a wristlet (FIG. 3A) and by sliding fastener 322 down the entire length of slot 315, the strap 320 will retract through slit 317 and be positioned within spine 306 allowing the bag portion 302 to function as a clutch, as shown in FIG. 3B. The spine 306 is constructed using an inner lay of material (not shown) which serves two functions. First the inner layer of material separates the interior of the bag portion 302 from the slot 315 so that the contents of the bag portion do not fall out through the slot 315, and second this inner layer of material also keeps the strap 320 from falling into the interior of bag portion 302 thus keeping the strap 320 in position. Fastener 322 may be a Chicago screw which would allow the user to tighten the screw anywhere along its path in slot 315 and thus pinch the edges of slot 315 securing the fastener 322 in a fixed position thus also determining the size of the wristlet so that it can be worn comfortably on the user's wrist.

Figure 4A:
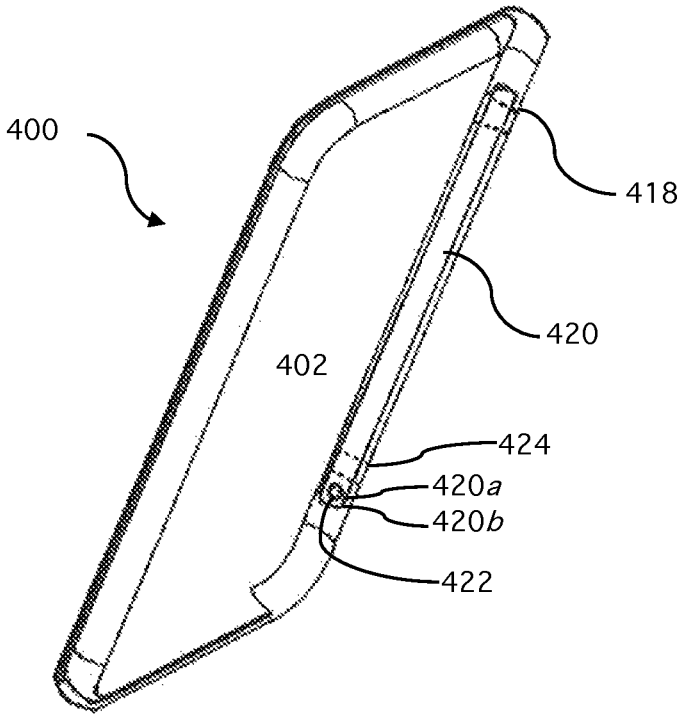
FIG. 4A is a perspective view of an embodiment of a multi-functional strap which allows the user to convert a personal item to a wristlet configuration.
Figure 4B:
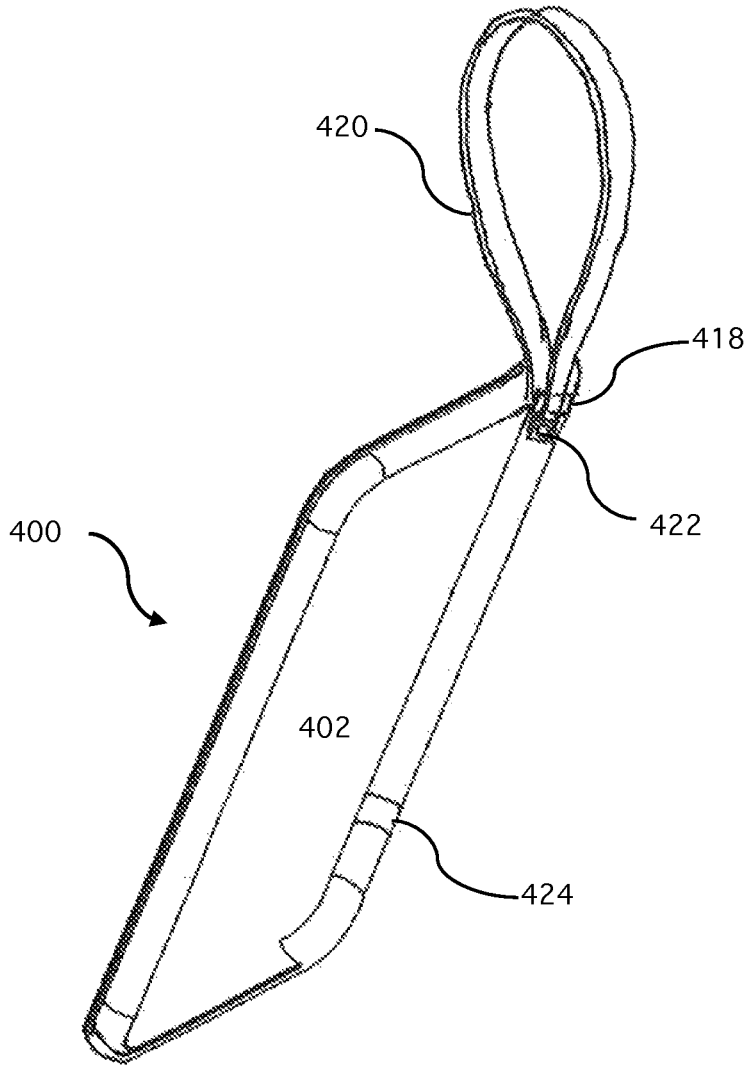
FIG. 4B is a perspective view of an embodiment of a personal item shown in FIG. 4A having a multi-functional strap having a wristlet configuration.

In the fourth and final configuration, shown in FIGS. 4A-4B, the personal item used to illustrate the versatility of the present invention is a cell phone case 402 having two loops 418 and 424 attached to one edge of the case. Strap 420 is conveniently stored in place along the edge of case 402 by threading it through loops 418 and 424 and securing the free ends using fastener 422. To achieve a wristlet configuration the ends 420*a* and 420*b* of strap 420 are decoupled, removed from loop 424, and then recoupled so that strap 420 is secured to cell phone case 402 vis-a-vis loop 418 formin a wristlet configuration.

Having disclosed several embodiments, it will be recognized by those of skill in the art that various modifications, alternative constructions, and equivalents may be used without departing from the spirit of the disclosed embodiments. Additionally, a number of well-known processes and elements have not been described in order to avoid unnecessarily obscuring the present invention. Accordingly, the above description should not be taken as limiting the scope of the invention.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A wristlet style handbag with a multi-function strap system, comprising:

a bag portion having an inside surface, an outside surface, a top end, a bottom end opposite of the top end, a first side, a second side, a third side, and a fourth side, wherein the first side, the second side, the third side, and the fourth side form a perimeter of the bag portion, and wherein the first side, the second side, and the third side are configured to form an opening of the bag portion;

a strap having a first end and a second end;

two or more loops positioned on said fourth side of said bag portion;

a fastener for coupling and decoupling said first end and said second end of said strap, wherein said strap is secured in place by one of said two or more loops and said first end and the second end of said strap are coupled forming a wristlet or wherein said strap is secured in place by said two or more loops, said first end and said second end of said strap are configured to be secured together to form a folded strap having a length and wherein said length of said folded strap is less than a length of said fourth side of said bag portion.

2. The wristlet style handbag of claim 1, wherein to provide a handbag configuration:

said first end and second end of said strap are decoupled;

said second end of said strap is passed through a second of the two or more loops thereby securing said strap in place by said two or more loops on said fourth side of said bag portion;

said strap is folded back on itself and the first end and the second end of said strap are again coupled to form a handle.

3. The wristlet style handbag of claim 1 further comprising a closure assembly positioned on a portion of the opening of the bag portion.

4. The wristlet style handbag of claim 3, wherein the closure assembly is at least one of a zipper, clasp, teardrop closure, kiss lock closure, squeeze frame, magnetic assembly, and hook and loop fastener.

5. The wristlet style handbag of claim 3, wherein the closure assembly comprises a zipper that extends along a portion of the first side, the second side, and the third side.

6. The wristlet style handbag of claim 1 further comprising a fastener loop, wherein the fastener loop is configured to secure the first end of the strap adjacent to the second end of the strap.

7. The wristlet style handbag of claim 6 further comprising a free loop, wherein the free loop is positioned adjacent to the fastener loop and is configured to adjust a size of the wristlet and in fastening the strap to a wrist of a user.

8. The wristlet style handbag of claim 1, wherein the fastener comprises at least one of a Chicago screw, snaps having a female snap element and a male snap element, magnets, and button studs.

9. The wristlet style handbag of claim 1, wherein the bag portion comprises at least one of leather, vegan leather, vinyl, synthetic fabrics, non-synthetics fabrics, and 3D printed fabrics.

10. The wristlet style handbag of claim 1, wherein the strap comprises at least one of leather, vegan leather, vinyl, synthetic fabrics, non-synthetics fabrics, and 3D printed fabrics.

11. The wristlet style handbag of claim 1, wherein the fastener is a screw post and is attached to the first end of the strap and the second end of the strap comprises an opening to receive the screw post.

* * * * *